US008136633B2

(12) United States Patent
Rogers

(10) Patent No.: US 8,136,633 B2
(45) Date of Patent: Mar. 20, 2012

(54) MODULAR SCAFFOLD SYSTEM

(76) Inventor: Peter J. Rogers, Barrie (CA)

( * ) Notice: Subject to any disclaimer, the term of this patent is extended or adjusted under 35 U.S.C. 154(b) by 838 days.

(21) Appl. No.: 12/230,522

(22) Filed: Aug. 29, 2008

(65) Prior Publication Data

US 2009/0301815 A1 Dec. 10, 2009

(30) Foreign Application Priority Data

Jun. 10, 2008 (CA) ..... 2634573

(51) Int. Cl.
*E04G 7/00* (2006.01)

(52) U.S. Cl. ..... 182/178.1; 182/186.8; 403/49

(58) Field of Classification Search ..... 182/186.7, 182/186.8, 178.1; 403/49
See application file for complete search history.

(56) References Cited

U.S. PATENT DOCUMENTS 1,448,503 A * 3/1923 Palmer-Jones ..... 52/638
3,506,090 A * 4/1970 Beziat ..... 182/178.6
3,807,120 A * 4/1974 Viandon ..... 52/638
4,015,395 A * 4/1977 Gostling ..... 52/637
4,530,616 A * 7/1985 Roux ..... 403/246
4,586,844 A * 5/1986 Hammonds et al. ..... 403/287
4,718,787 A * 1/1988 Bahloul ..... 403/175
6,027,276 A * 2/2000 Schworer ..... 403/49

* cited by examiner

*Primary Examiner* — Alvin Chin Shue

(57) ABSTRACT

A modified scaffold support post includes areas of reduced diameter, intermediate the length of the support post, having connecting rosettes secured to these reduced diameter areas. Preferably the areas of reduced diameter correspond to diameter of support tubes used as uprights in scaffold frames in North America (approximately 1.69 inches in outer diameter). Preferably the areas of reduced diameter are formed by swaging a tube of a larger diameter, typically approximately 1.90 inches. The modified support post is advantageously used with scaffold frames with connecting rosettes appropriately positioned on the uprights of the scaffold frames.

20 Claims, 13 Drawing Sheets

MODULAR SCAFFOLD SYSTEM

FIELD OF THE INVENTION

The present invention relates to scaffolding systems and in particular to a modified scaffold post and frame scaffolding system.

BACKGROUND OF THE INVENTION

Scaffolding systems can be generally divided into three major types of systems, namely tube and clamp systems, frame and cross-brace systems, and modular systems. The tube and clamp systems are extensively used in the industrial sector and are easily adapted to cope with confined spaces where there are many obstructions such as pipes, stairways, structural steel frameworks, etc. These systems require considerable expertise to erect correctly, and are almost always erected by experienced professional scaffold erectors. With the more recent adoption of modular systems, the tube and clamp systems are now primarily used only for infill areas that cannot be effectively serviced by the modular systems.

Frame and cross-brace systems are very common and these systems are typically used in commercial applications by painters, bricklayers, masons and many other trades to provide effective elevated work platforms. These systems may be used in industrial applications for low rise applications or for other specific uses where guardrails and tie-off rules are less stringent. The frame and cross-brace systems are less rigid as there is some pivotal movement of the frames due to tolerances with respect to the cross-braces. In many jurisdictions, the safety authorities reject the use of cross-braces as effective guardrails and often tubular or wooden guardrails are required in addition to the cross-braces. In order to restrict the weight of the frames, which are typically five feet wide and six feet in height, the tubes used in the frames have an outer diameter of approximately 1.69 inches. In contrast, the support posts of the tube and clamp systems are typically of a diameter of approximately 1.90 inches and of a higher load carrying capacity.

Modular systems have also been used for high load applications typically associated with industrial applications. These systems are made of pre-engineered components of specific lengths. The components have integral connection devices that allow connection between the different components of the system, and the system is easily erected in different configurations. These types of systems are commonly used in industrial applications such as refineries and power stations. In North America, the support posts of these systems are typically 1.90 inches in diameter. Frames are typically not used in this type of modular system in that frames made of 1.90 inch diameter tube and of a typical width of approximately 5 feet, are too heavy to be easily carried by a worker. As previously indicated, frame-type systems are typically of smaller diameter tube to keep the weight as low as possible. Typically, the above-described systems are not inter-compatible.

As labour costs continue to rise, there is a preference for scaffolding systems that are easy to erect. In this way the contractors, that are operating on small margins, are able to erect the system quickly and at reduced cost. The frame and cross-brace type systems are fast to erect and easy to use, and do not require the expertise necessary for tube and clamp and modular systems. The use of frame-type systems can result in a labour saving in the order of 35%.

The present invention utilizes a modular scaffold system that advantageously provides inter-compatibility between a support post-type system and a frame-type modular scaffolding system. This inter-compatibility allows for effective use and labour saving where frames can be suitably used while also providing the higher load capabilities of a support post-type modular system where required. The inter-compatibility of the systems allows the various connecting components such as ledgers and cross-braces to be of the same length while maintaining modularity of the system.

SUMMARY OF THE INVENTION

A scaffold support post according to the present invention comprises an elongate tube with a series of securing rosettes at spaced positions in a length of the elongate support tube. The elongate tube is of a first diameter and includes adjacent each securing rosette, an inwardly recessed segment sized to receive and engage a ledger head both above and below the respective rosette at various securing positions around the rosette.

According to an aspect of the invention the inwardly recessed segments of the scaffold support post are of a reduced diameter relative to the first diameter.

In an aspect of the invention, each inwardly recessed segment includes an area above the rosette of the reduced diameter and a separate area below the rosette of the reduced diameter.

In an aspect of the invention, the support post at each rosette is of the first diameter.

In a further aspect of the invention, each rosette includes a circular port sized to initially sleeve over the first diameter of the scaffold leg and is welded to the support post on a portion of the first diameter.

According to an aspect of the invention each rosette is welded to a narrow band portion of the elongate tube and the narrow band portion is of the first diameter.

In a preferred aspect of the invention, the scaffold support post is part of an integrated scaffold post and scaffold frame system where each scaffold frame includes two connected upright members and each upright member is a tube member of a diameter corresponding to the reduced diameter.

In a preferred aspect of the system of the present invention the scaffold frames include rosettes for connecting frames to frames or frames to support posts using the same connecting components and maintaining the same grid spacing whereby a frame can be replaced by two scaffold posts or two appropriately spaced support posts can be replaced with a frame without altering the grid spacing.

An integrated scaffolding system according to the present invention comprises scaffold support posts, scaffold frames, and connecting ledgers and diagonal braces for securing the scaffold posts and the scaffold frames in predetermined modular spacing that allows scaffold posts to be substituted for scaffold frames while maintaining the same modular spacing. Each scaffold support post comprises an elongate tube with a series of securing rosettes at spaced positions in a length of the elongate support tube. The elongate support tube is of a first diameter and includes adjacent each securing rosette, an inwardly recessed segment sized to receive and engage a ledger head both above and below the respective rosette at various securing positions around the rosette.

In a preferred aspect of the system of the present invention the inwardly recessed segment is of a reduced diameter relative to the first diameter.

In a further aspect of the system the inwardly recessed segment includes an area above the rosette of the reduced diameter and a separate area below the rosette of the reduced diameter.

In a further aspect of the system the support post at each rosette is of the first diameter, preferably about 1.90 inches outer diameter.

In a preferred aspect of the system, each rosette includes a circular port sized to initially sleeve over the first diameter of the elongate support tube and is welded to the support post on a portion of the first diameter. Preferably each rosette is welded to a narrow band portion of the scaffold support post and the narrow band portion is of the first diameter.

In a preferred aspect of the system the support post has a first diameter of approximately 48 mm and a wall thickness of approximately 3 mm and the reduced diameter is of an outer diameter of approximately 42 mm.

In an aspect of the invention, each scaffold support post has at least 2 rosettes spaced in the length of the elongate support tube.

BRIEF DESCRIPTION OF THE DRAWINGS

Preferred embodiments of the invention are shown in the drawings, wherein.

DETAILED DESCRIPTION OF THE PREFERRED EMBODIMENTS

As indicated in the background of the invention, scaffolding systems, particularly for industrial applications, require substantial load-carrying capabilities, and as such, support posts are often used where the outer diameter of the support posts is approximately 1.90 inches. These support posts are easily carried by a single worker, and the support posts typically have a number of connection points at pre-determined positions intermediate the length of the support post. These support posts are inter-connected by ledgers such as ledgers 10 and these types of systems also include diagonal brace-type members of the appropriate length. With such a post system, the modular spacing between posts is effectively fixed by the connecting components.

Figure 1:
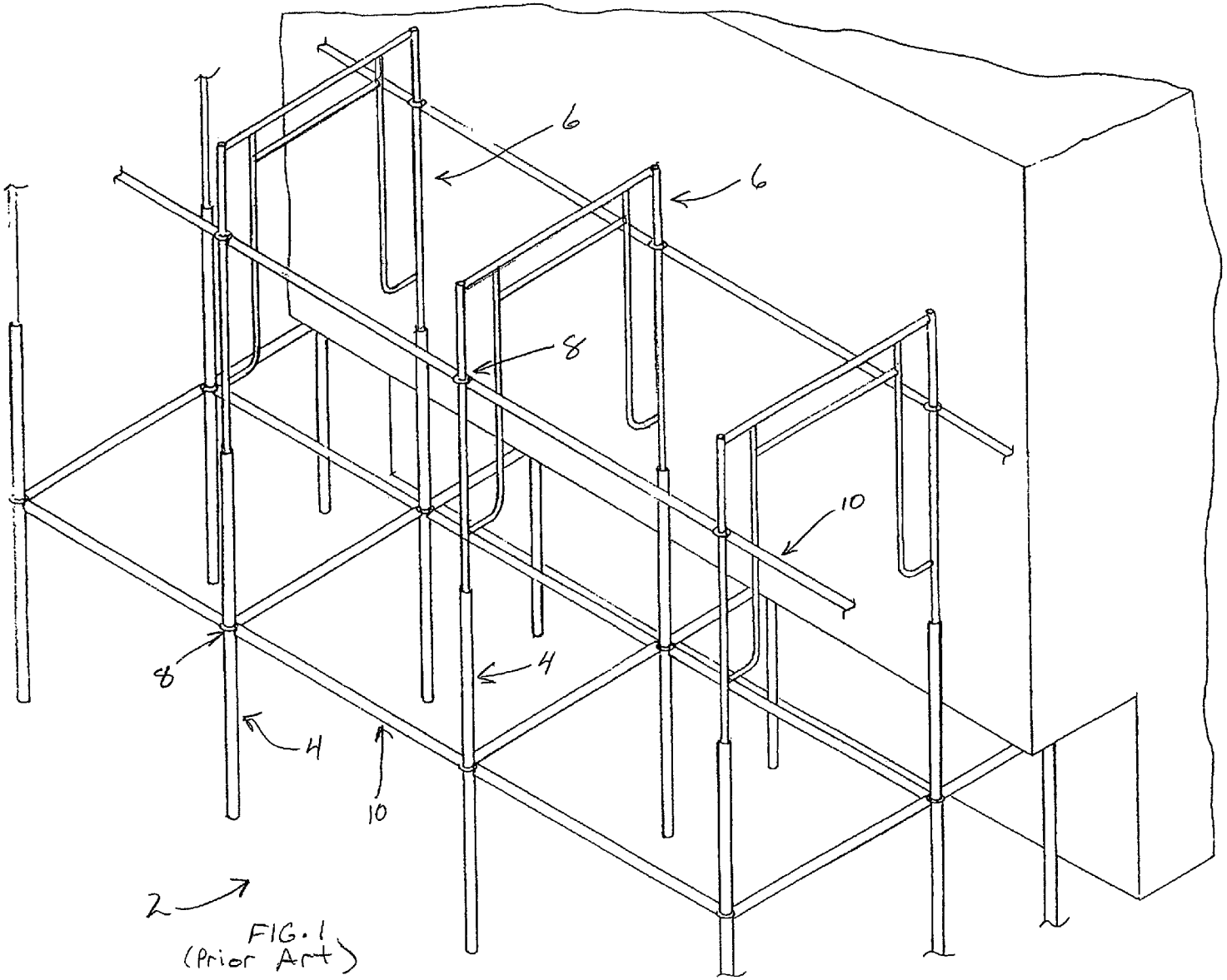
FIG. 1 (Prior Art)
FIG. 1 is a partial perspective view of a support post scaffolding system in combination with a modular frame system.
Figure 2:
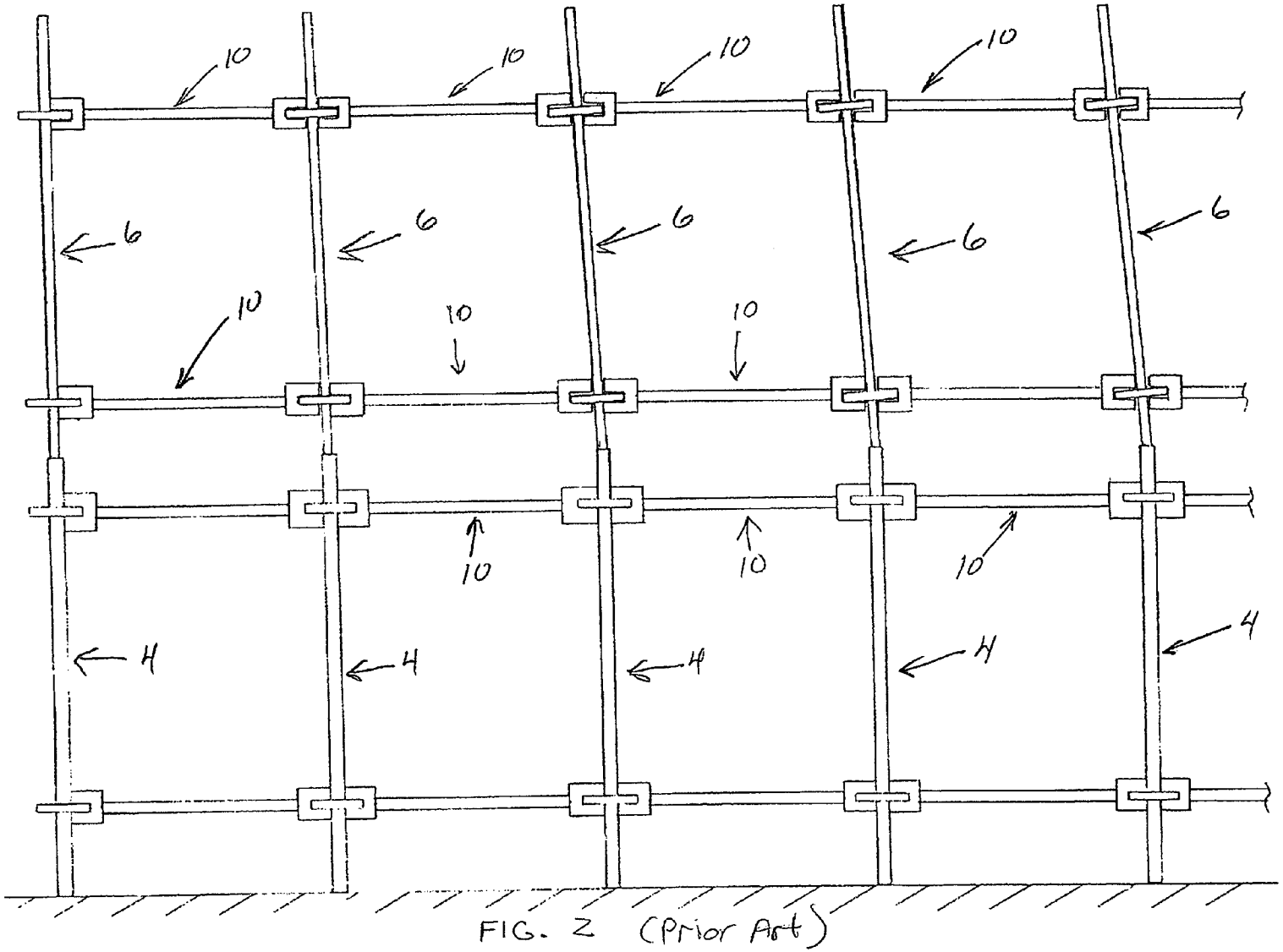
FIG. 2 (Prior Art)
FIG. 2 is an elevational view of a support post system with a modular frame system positioned thereabove and the problems associated with the cumulative effect of off-modularity of the two systems.

As shown in FIG. 1, frame systems such as frames 6 can also be connected in a similar manner to the connection between the scaffold posts indicated as 4. If the same connecting components used for the scaffold post system are used in the frame system, the modularity of the frame system is determined by these connecting components. This creates a problem in that the uprights of each frame system are of a reduced diameter, typically 1.69 inches, which is necessary to maintain the frame at a weight that is easily carried by the workers. As shown in the elevational view of FIG. 2 the initial change in the modularity on the left side of the Figure is not that great, however the change in modularity continues to accumulate, and as shown with the frame 6 at the right side of the Figure, it has now been placed at a substantial angle and the load-carrying capability thereof is greatly reduced. It is certainly possible to develop a scaffold support post system having uprights of the same size as the frames 6, however the industry generally wants the higher load-carrying capability of the larger-diameter support posts. The industry also prefers to use the modular systems where less expensive labour can be used to erect the system, and as such, a standardization of the connecting components such as the ledgers and cross-braces has resulted in the non-integration of such systems.

Figure 3:
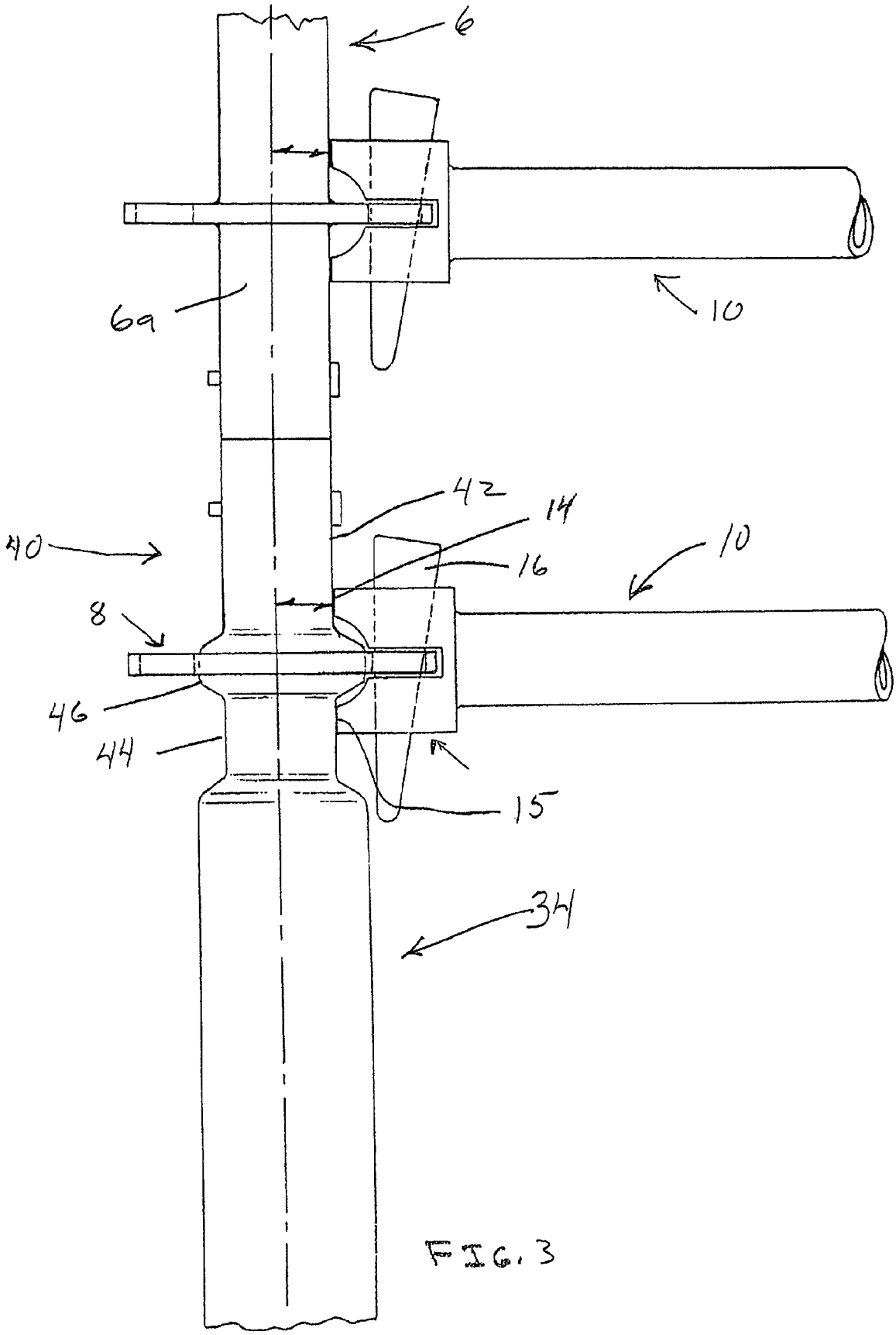
FIG. 3 is a partial vertical view of a modified scaffold support post in combination with a modular frame system where common ledgers are used between these systems.
Figure 4:
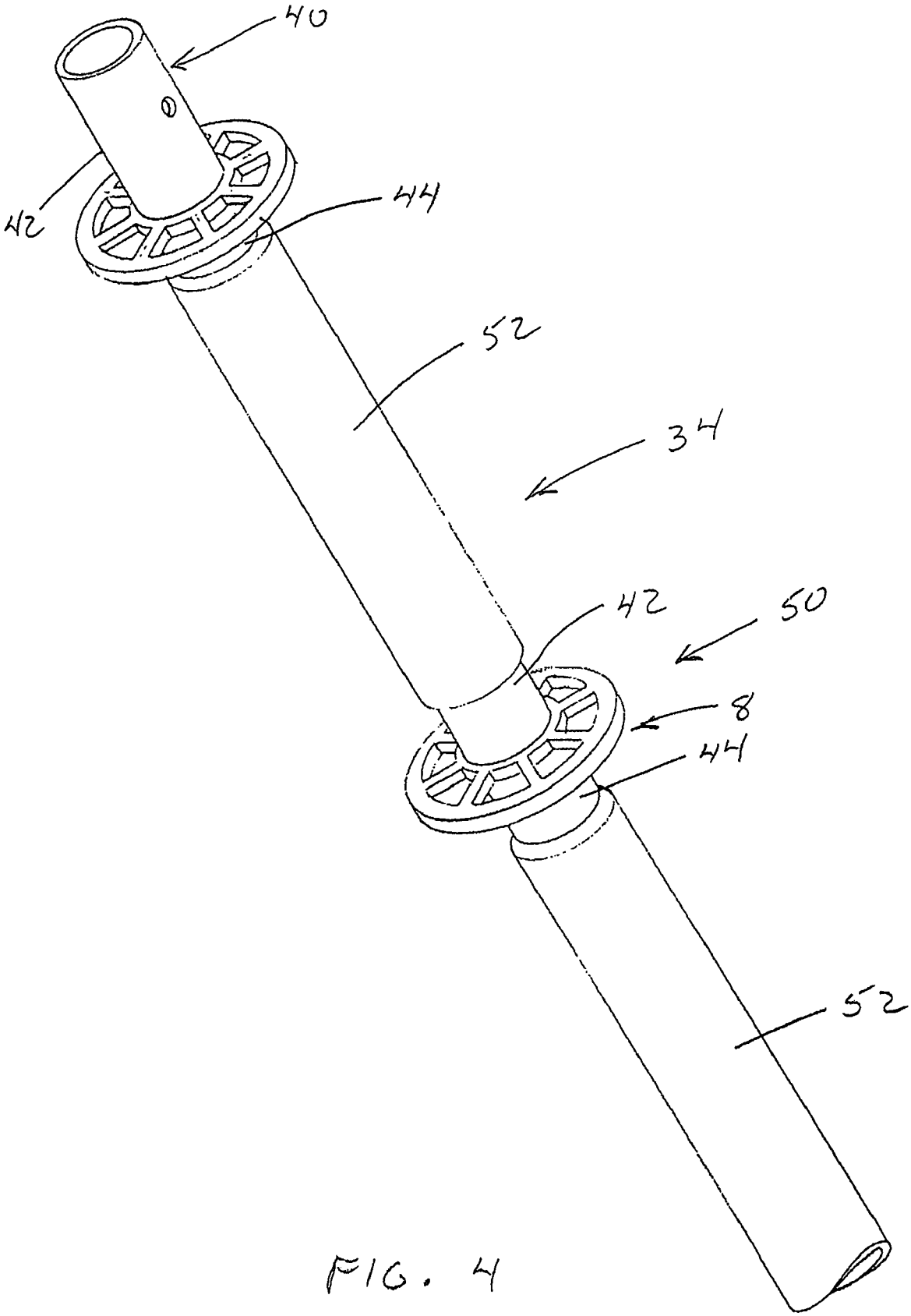
FIG. 4 is a partial perspective view of a modified scaffold support post.

The modified scaffold support post 34 shown in FIG. 3 has been designed to effectively overcome the difficulties described above and the problems indicated in FIGS. 1 and 2. In this case, the support posts 34 are of the larger diameter 1.90 inches (48 mm), but include at the connection points, areas of reduced diameter to effectively match with the reduced diameter of the frame uprights, namely the diameter of approximately 1.69 inches (42 mm). The connecting component, such as the ledger 10 as shown in FIG. 3, is thus able to maintain the identical modularity between support posts 34 and the frames 10. This modularity is maintained in that the connection is always based on the smaller diameter upright. Although the ledger 10 is shown, any cross-bracing and other specialized components will also be fully integrated into the system as the modular spacing is now common between the frame and the support posts.

In order to manufacture the support post 34 in a cost-effective manner, the support post is made of an elongate tube 34 of the larger diameter that is effectively reduced at the connection points to the smaller diameter size. This reduction to the smaller diameter size is preferably formed by swaging of the larger diameter tube. Some reduction in the load-carrying capacity of the tube does occur, however this reduction is tolerable in that the modularity of the system is maintained. The cost advantages of erecting an effective work platform using frames where appropriate, more than offsets the additional cost or small reduction in load carrying capability of the support posts. The system allows the support posts to be used where their higher capacity is required or where the particular structure demands the use of support posts.

The modified support post 34 as shown in FIGS. 3, 4, 5 and 6, includes an end portion 40 of reduced diameter to correspond typically with the size of the upright 6*a* of the frame. In these Figures, the end portion 40 includes an upper reduction 42 separated from the lower reduction 44 by the securing ring 46 of the original larger diameter. This securing ring 46 is sized to receive the rosette 8 and typically the rosette 8 is welded to this securing ring. With this arrangement the port in the rosette would be sized for the larger diameter of the tube and secured on the securing ring. This type of connection is particularly advantageous for the intermediate connecting points generally in the middle portions of the support post. The rosette can be sleeved over the larger diameter of the support tube and then positioned on a securing ring of a reduced connecting portion. For example, in a six foot support post there are rosettes at the top and bottom of the support post and these portions would be of reduced diameter. Typically there would be two intermediate rosettes and these would be located on the reduced connecting portions at the securing rings.

A preferred spacing between the two intermediate rosettes is approximately 500 mm. The reduced connecting portions are sized (i.e. of a length) to accommodate the ledger heads and are preferably less than 100 mm. In one preferred design the total reduced length including the rosette attachment portion is approximately 80 to 85 mm. It is desirable to keep this reduced area as short as possible while still allowing ease of securement and release of the ledger heads. The actual length of the reduced area is a function of the ledger head, the rosette and ease of assembly.

The swaged area at the top and bottom of the support post is preferably approximately 150 mm and would include the area where the rosette is attached.

Figure 5:
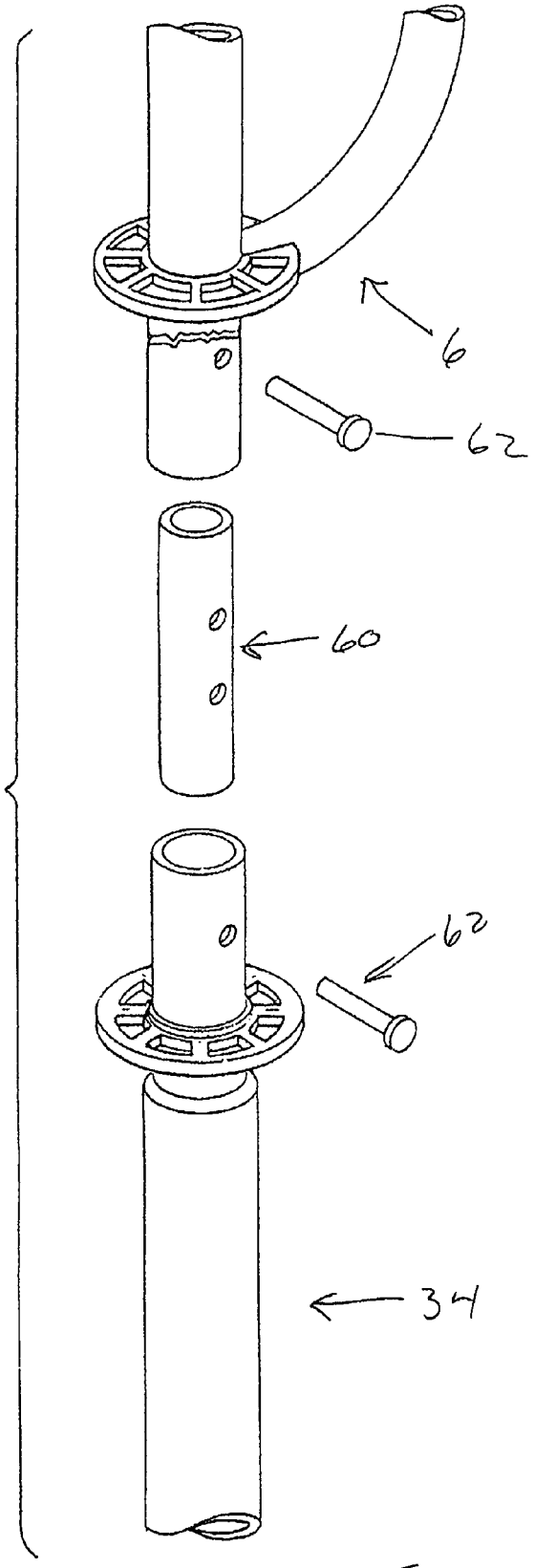
FIG. 5 is a partial perspective view showing the modified scaffold support post and a bottom portion of a scaffold frame.
Figure 6:
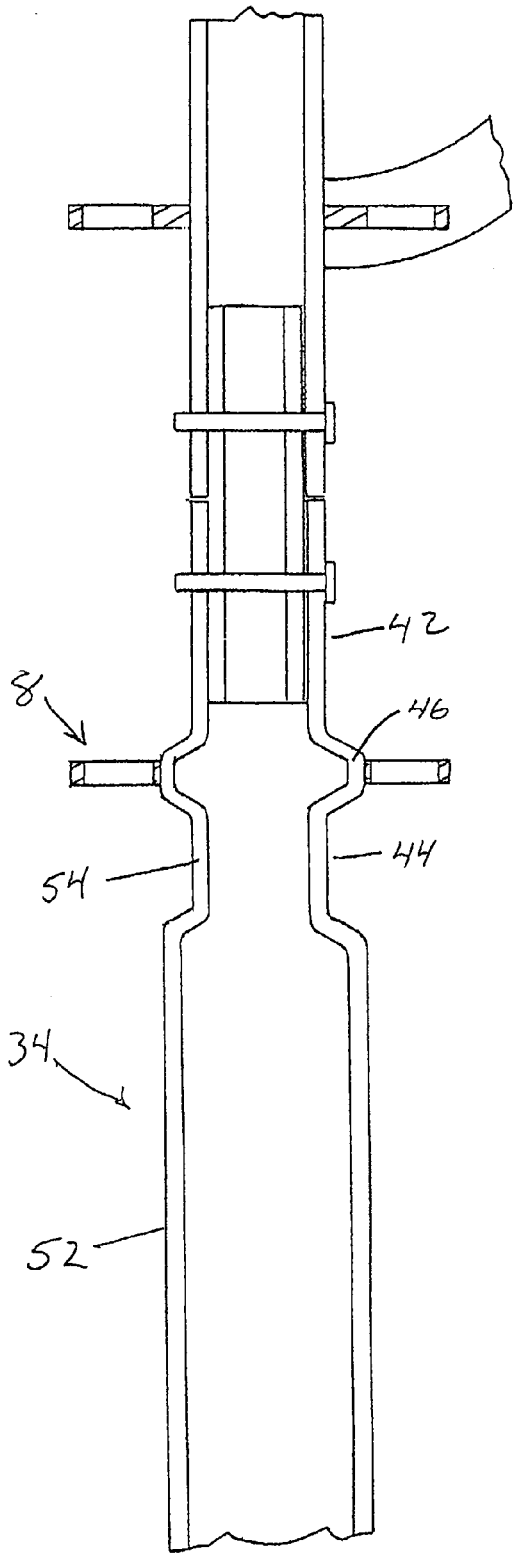
FIG. 6 is a cross-sectional view showing the connection of the modified scaffold post and modular scaffold frame of FIG. 5.

As best shown in FIG. 3, the ledger 10 used to connect the frames and the ledger 10 used to connect support posts, are all based on the smaller diameter sections and as such modularity is maintained. Thus support posts can be connected to horizontally adjacent support frames and support posts can easily be replaced by support frames. Frames can be stacked above support posts without changing any of the modularity of the system. The particular connections of the support posts to the frames as shown in FIGS. 5 and 6 illustrate the reduced end portion 40 that receives the connecting spigot 60 that is inserted in the end portion 40 and is held in position due to the locking pin 62. Similarly, the spigot 60 is locked to the frame by the upper locking pin 62. This is merely one example of the mechanical connection that is possible between the support posts and the scaffold frames. Other arrangements are clearly possible. It is preferable that the ends of the support posts are of the reduced diameter but it is not essential.

With the present invention, the scaffold support post includes at its ends and at intermediate portions along its length areas of reduced diameter sized and adapted to provide modular connecting points. These modular connecting points are designed to be compatible with the smaller diameter uprights of the support frames. With this arrangement, support posts can be effectively manufactured using the standard larger diameter tubes such as 1.90 inches in diameter, and these tubes can be swaged at appropriate points to provide the necessary reduction in diameter. The face to face connection of the ledgers 10 i.e. the upper and lower abutting faces 14 and 15 of the ledgers on these reduced portions, is the same as would be achieved with respect to the ledger head connecting to the upright of the scaffold frame. Thus the connections are common between the two components of the system and the advantages with respect to labour are maintained.

With the above system, there are many applications where the design of the scaffold for carrying out a particular job can advantageously use the support posts where required and the frames where required. With this system the higher load-carrying capability of support posts can be used where required and the labour advantage associated with the use of support frames are easily achieved where frames are more suitable. The system allows for effective overall design to meet any particular needs.

With this system the support posts at the connection points require a reduced area to appropriately abut with connecting components used in frame systems. The actual stack connection of a post to frame or frame to post is preferable to use the same size end segment to match a frame to frame connection but specialized adapters could be used.

Figure 7:
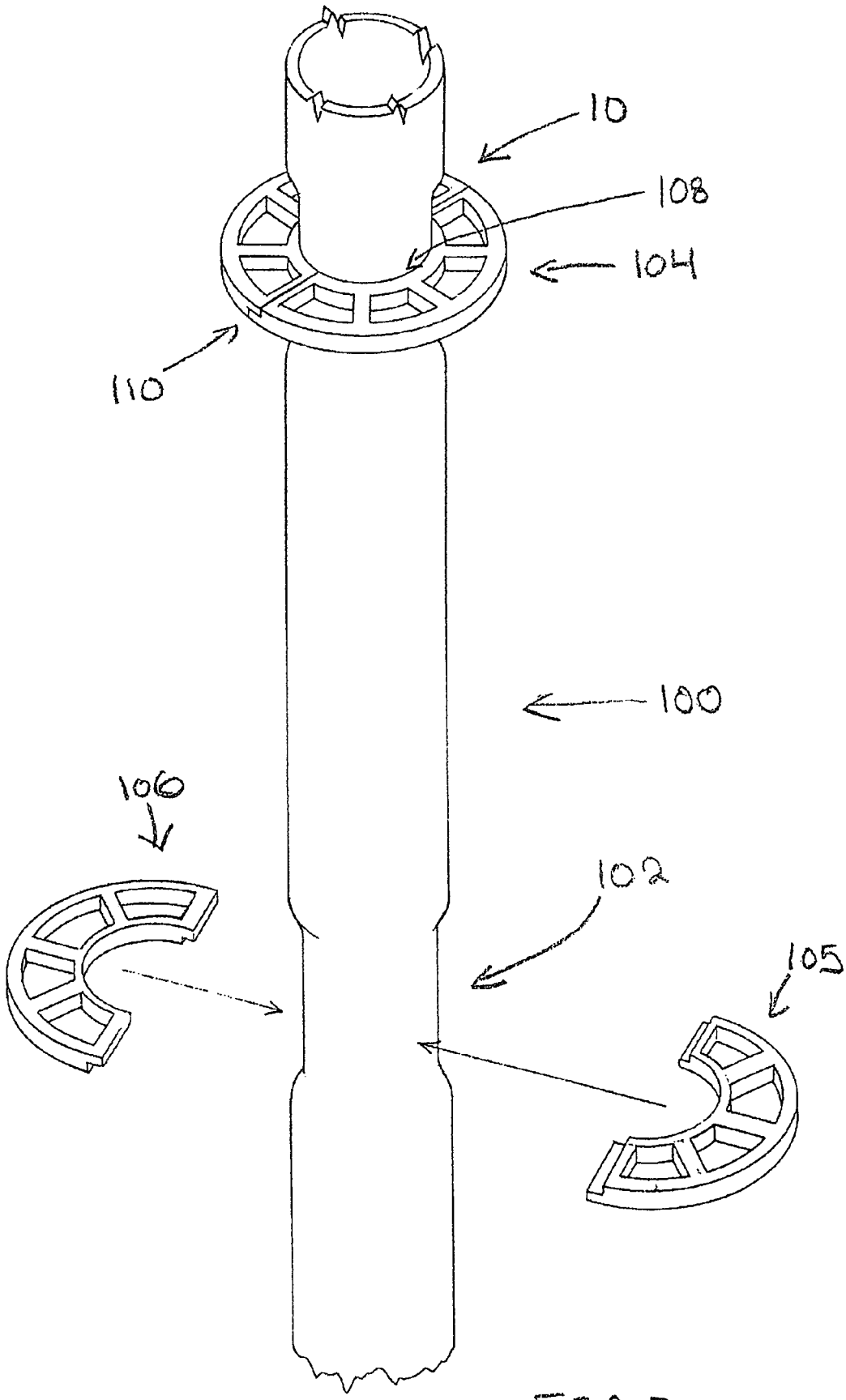
FIG. 7 is a partial perspective view of a modified scaffold support post.

The modified scaffold support post 100 shown in FIG. 7 includes one example of a two-piece rosette 104 that is welded to reduced areas 102 of the support post. In this case, the reduced areas 102 are of a generally constant diameter and are typically formed by swaging of the support post. The two-piece rosette 104 includes sections 105 and 106 that are actually the same component but merely reversed in orientation. Each of the components 105 and 106 has part of an interior port that abuts with the diameter of the reduced section. The rosette is welded at 108 to the reduced section. Typically, the split rosette will also be welded at the split line 110.

With the two piece rosette 104 of FIG. 7, there is no requirement to provide a larger securing band area on the reduced section as shown in the earlier Figures.

It can be appreciated that there are other alternatives for forming of a two-piece type rosette which is welded and secured to the reduced sections.

Figure 8:
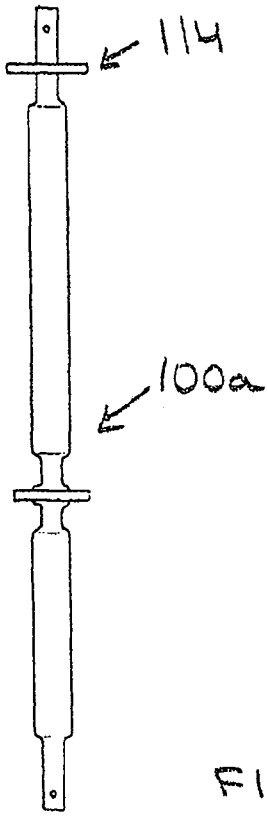
FIGS. 8, 9 and 10 are elevational views of scaffold support posts of different sizes.
Figure 9:
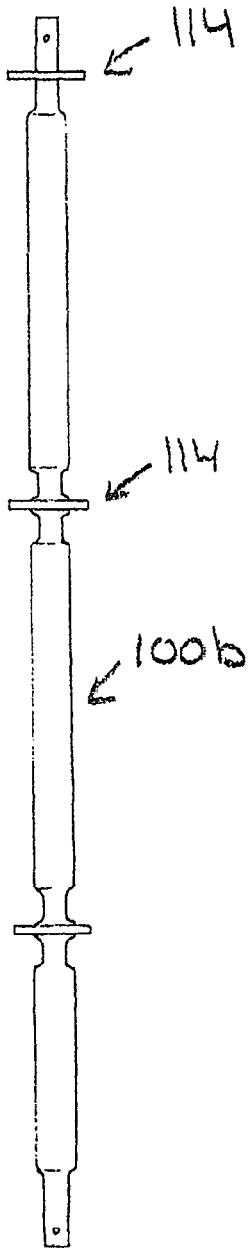
Figure 10:
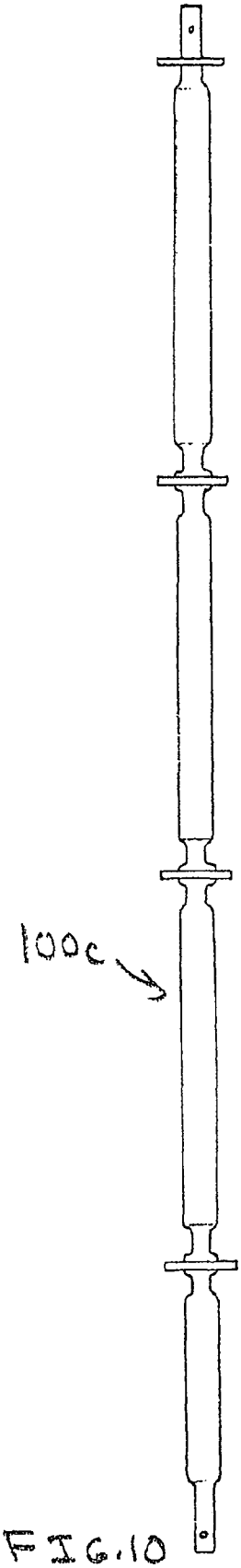

FIGS. 8, 9 and 10 show examples of different scaffold support posts 100*a*, 100*b* and 100*c* that are of different modular heights. Each of these support posts include connecting rosettes 114 at predetermined positions in the length of the support posts.

Figure 11:
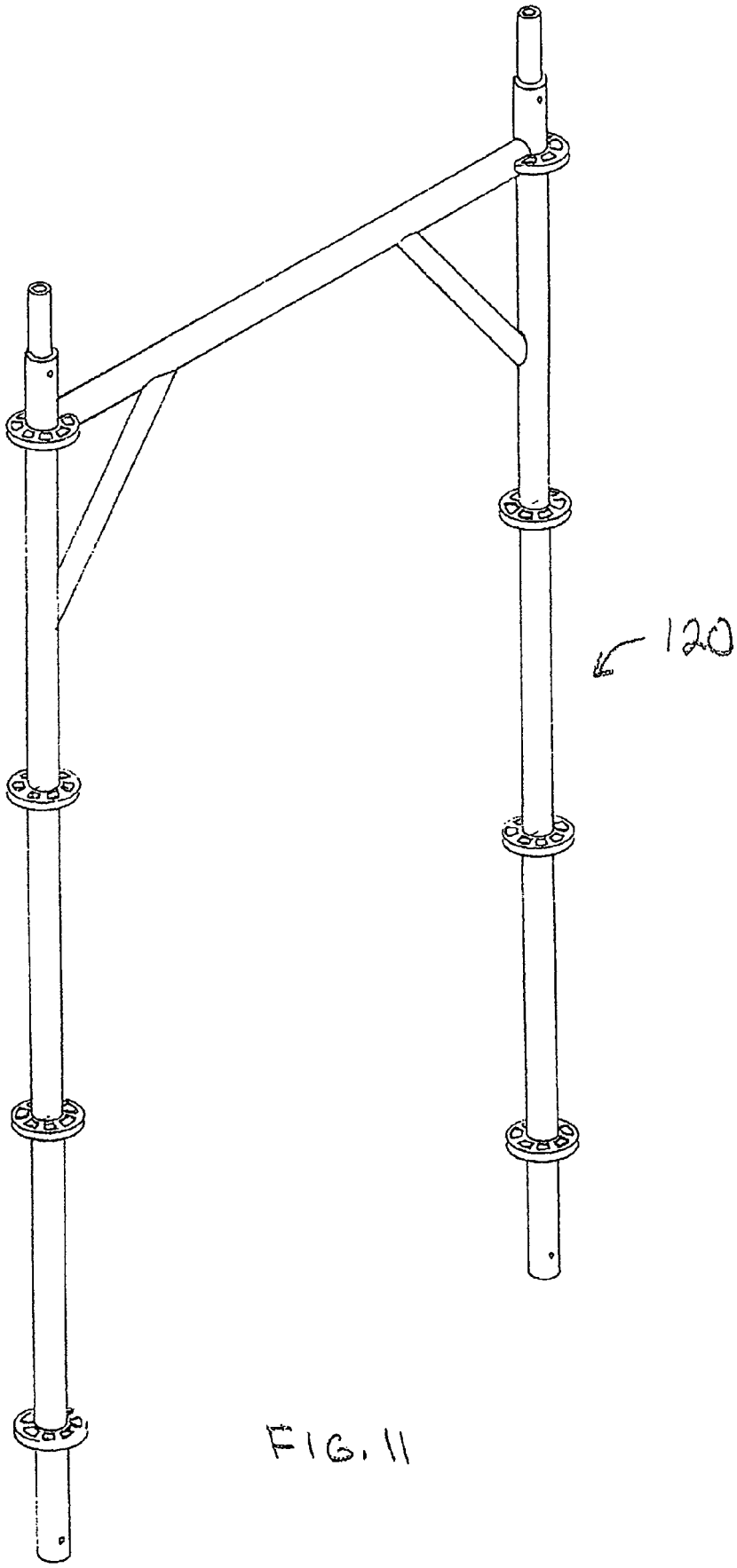
FIGS. 11 and 12 are perspective views of two different walk-through frames.
Figure 12:
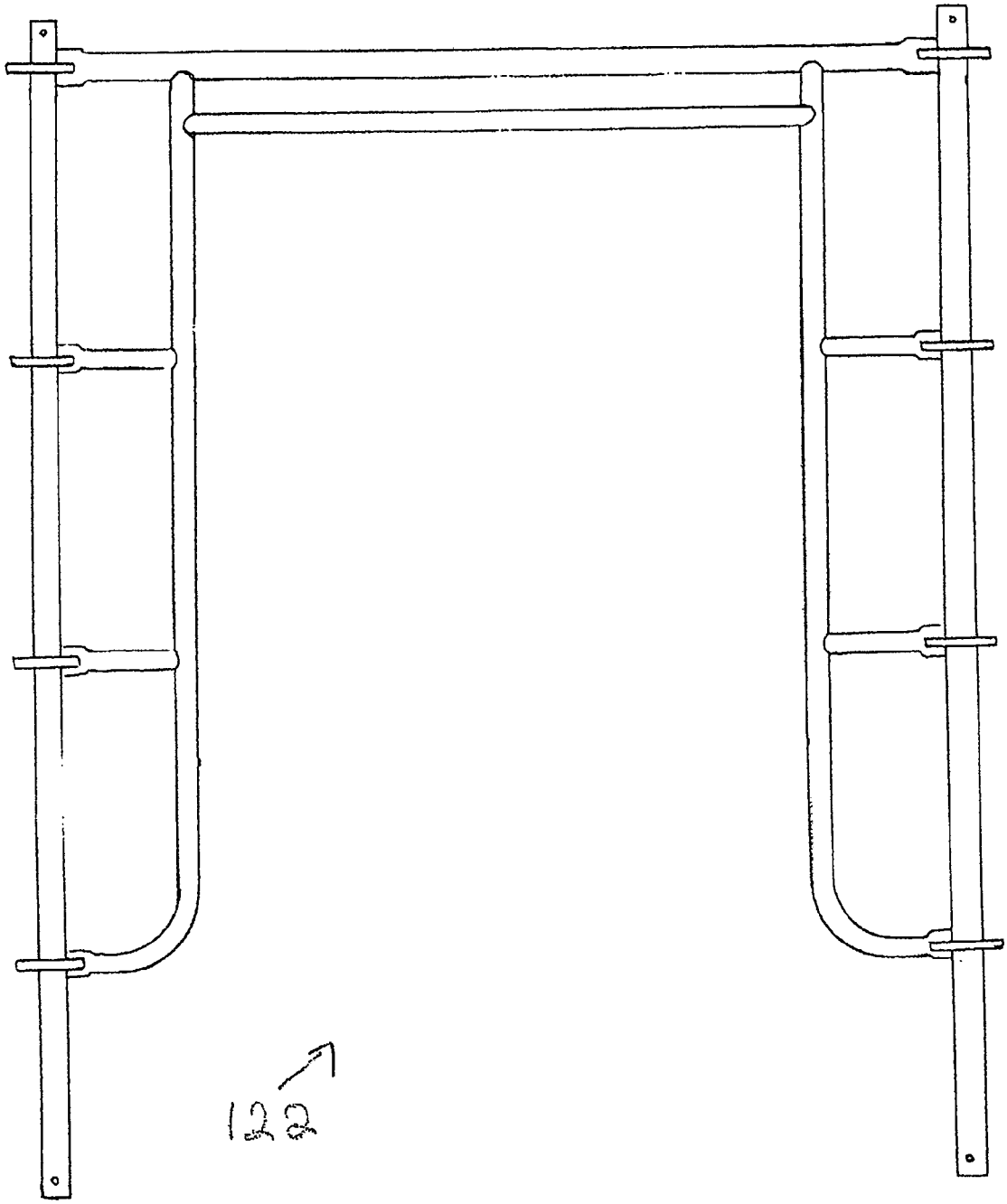
Figure 13:
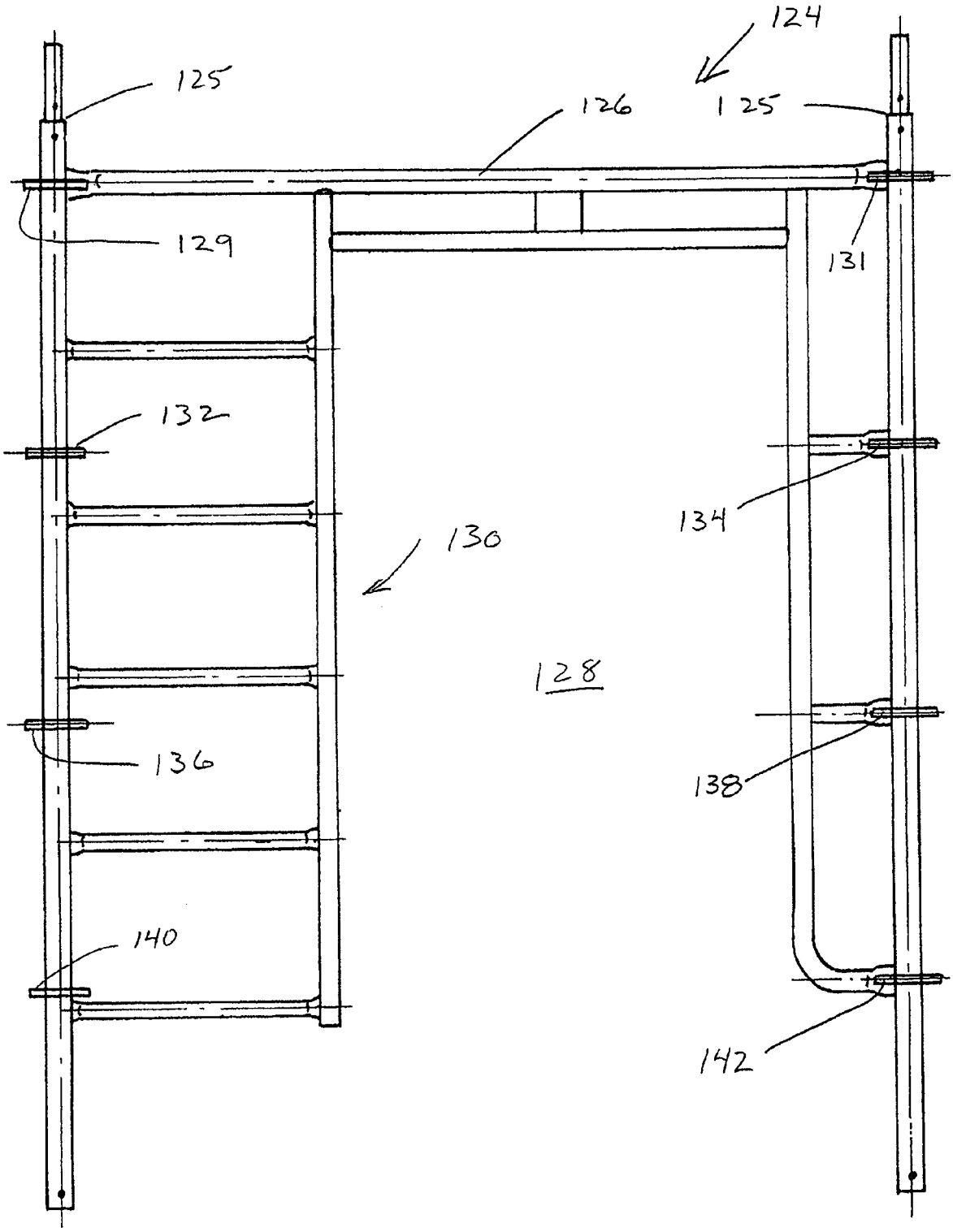
FIG. 13 is an elevational view of a walk-through access frame.

The integrated scaffolding system of the present invention uses the scaffold support posts in combination with scaffolding frames such as the walk-through frame 120 or the walk-through frame 122 of FIGS. 11 and 12. Each of these frames include connecting rosettes 114 at the appropriate modular spacing for effectively connecting with the rosettes of the scaffold support posts. Different types of scaffolding frames will all include the connecting rosettes 114 at the appropriate placements on the upright components. For example, the scaffolding frames could be any of the accepted walk-through type frames of FIGS. 11 and 12, mason frames, ladder frames or plasterer's frames, as are well known in the industry. Each of the uprights of these different types of frames will include an appropriate number and placement of the connecting rosettes 114. With this arrangement, the scaffolding frames with the rosettes can effectively connect with the scaffolding posts, and the scaffolding frames can also be used in their normal application. The typical connections provided on these known frames can be maintained and the rosettes are merely added. In this way, there may be applications where the traditional connection of the frames is preferred.

FIGS. 13 through 16 are examples of other frames that have been adapted to include the connecting rosettes and to also coordinate these connecting rosettes with horizontal structural members of the frames. The walk-through frame 124 of FIG. 13, when in use, has an overall height of approximately 2 meters, and the spigots at the top portions of the uprights extend above this height. The upper connecting rosettes are positioned preferably at 110 mm from the connecting edge 125 and the upper horizontal connecting component 126 is aligned with the upper rosettes. The frame includes the clear area 128 for walking through the frame and a ladder portion 130 provided in the left hand side. Each of the intermediate connecting rosettes 132, 134, 136 and 138 are positioned preferably at 500 mm from the centre line of the adjacent upper rosette. The bottom rosettes 140 and 142 are positioned preferably 500 mm from the next intermediate rosettes and at 390 mm from the base of the frame. The bottom rosettes (140, 142) when the frame is stacked on a similar frame or support post, will be spaced from the top rosette of the component below by 500 mm (390 mm plus 110 mm of the component below).

At the ladder portion 130 rosettes 132, 136 and 140 may have the portion of the rosette that extends into the ladder portion, (i.e. into the frame) removed to avoid the possibility of tripping during use of the ladder. Preferably the rosettes are positioned and cooperate with horizontal adjacent components of the frame.

Figure 14:
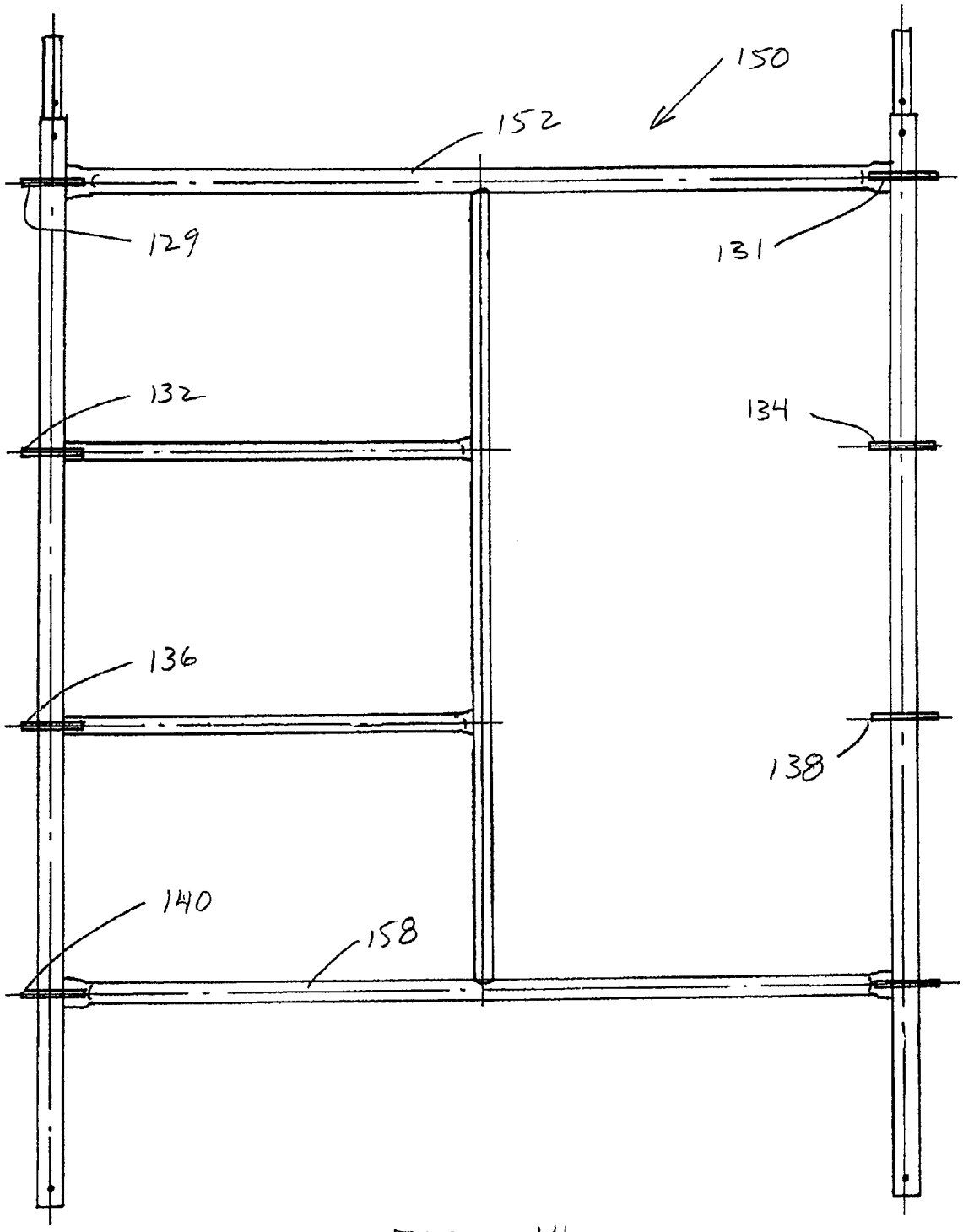
FIG. 14 is an elevational view of a mason frame.

In FIG. 14 a mason frame 150 is shown and the upper rosettes 129 and 131 are again positioned to align with the upper horizontal member 152. Rosettes 132, 136 and 138, provided at the left hand side of the frame are all at the same spacing as horizontal members 154, 156 and 158, and are aligned with and connected at the respective rosettes.

Figure 15:
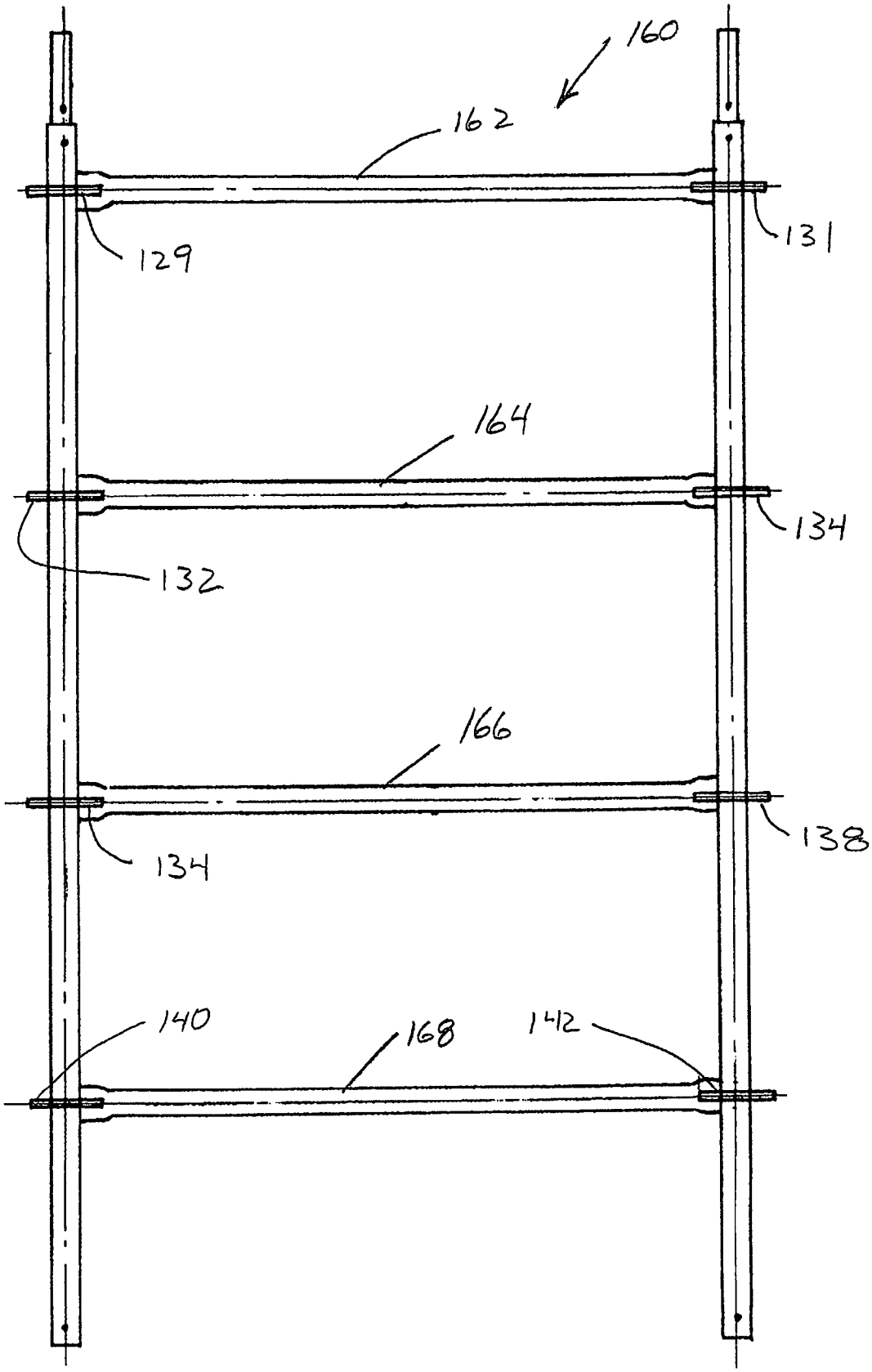
FIG. 15 is an elevational view of an end frame.

An end frame 160 is shown in FIG. 15 and includes 4 horizontal members 162, 164, 166 and 168 that are each aligned with a pair of the connecting rosettes. For example, horizontal member 162 is aligned with connecting rosettes 129 and 131.

Figure 16:
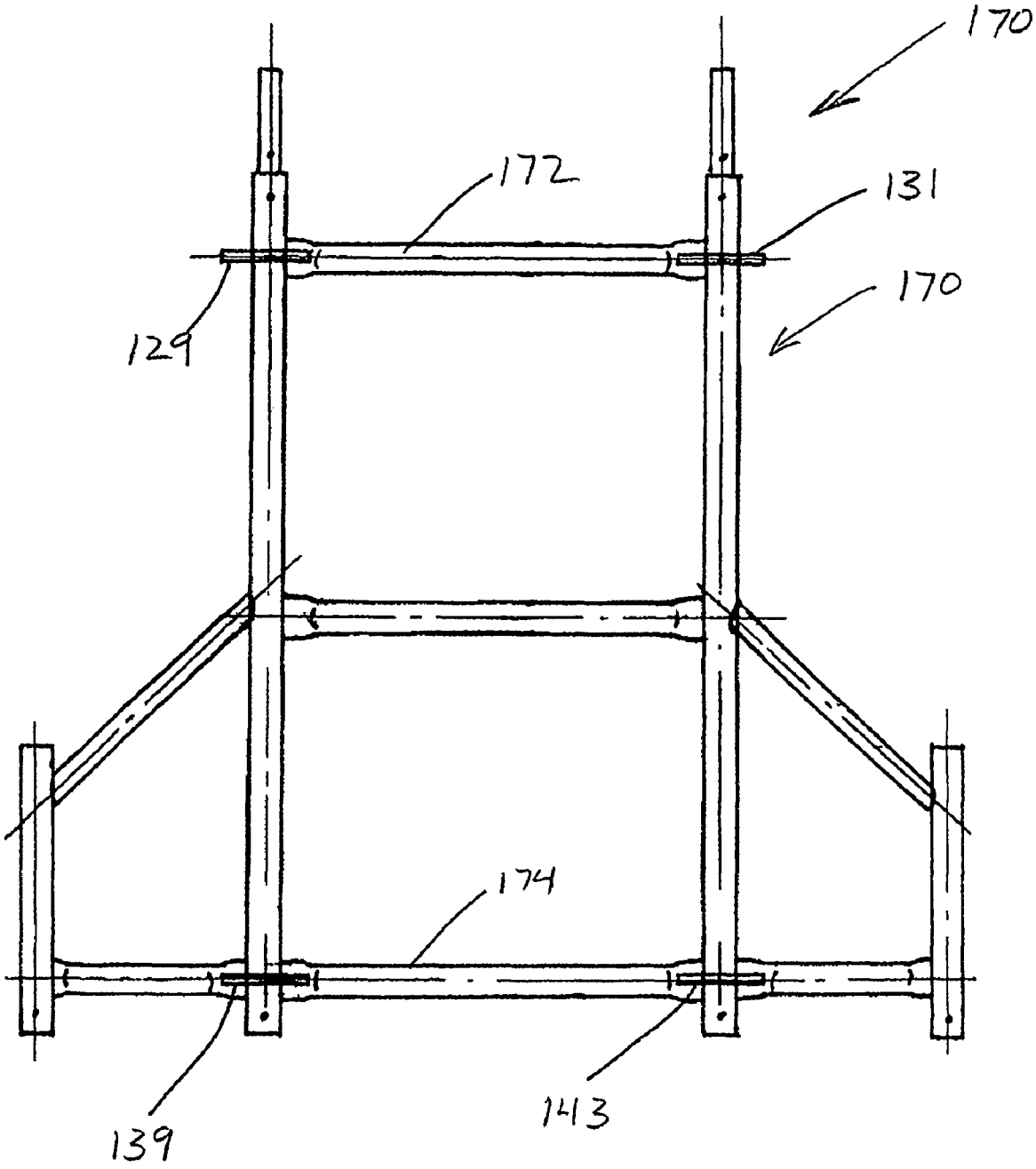
FIG. 16 is an elevational view of a base frame for a two-foot wide ladder frame.

In FIG. 16 a base frame 170 for two-foot wide ladder frames is shown. In this frame, upper rosettes 129 and 131 are positioned adjacent the horizontal member 172 and bottom rosettes 139 and 143 are provided adjacent the base of the frame and generally aligned with the horizontal member 174. Connecting rosettes 129 and 139 are vertically spaced by approximately 1000 mm. With the base frame 170, smaller two-foot ladder frames will be stacked above this frame.

Scaffolding frames are of various designs for specific applications. As part of the present scaffolding system using scaffolding support posts and scaffolding frames, any of these specialized frames can be used by appropriately placing connecting rosettes on the upright members of the frames. These frames can be modified to position horizontal members generally at the connecting rosettes, or the connecting rosettes can be adapted to not extend into the interior space of the frame if this may present a safety hazard, for example. The portion of the connecting rosette extending into the frame is not used, as the frame effectively forms this connection. It can be readily appreciated that any of the known scaffolding frames can be adapted to include the connecting rosettes appropriately spaced to be used as part of the present modular scaffolding system.

A typical scaffold frame with a height of approximately six feet is of a weight between about 45 to 55 pounds. This weight is capable of being carried by a workman. A single vertical upright of the present design with a length of about 10 feet weighs about 35 pounds and a six foot length weights approximately 25 pounds. A safe carrying load for a workman is typically 60 pounds or less and preferably between 50 and 55 pounds.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A scaffold support post comprising an elongate support tube of a predetermined length and of a first diameter; said elongate tube having a series of securing rosettes at spaced positions in a length of said elongate support tube with at least one securing rosette intermediate the length of said elongate support tube; said elongate support tube including adjacent said at least one intermediate securing rosette an inwardly recessed swaged segment having an outer wall portion generally parallel to and positioned inwardly of an inner wall of said elongate support tube in a non swaged region of said first diameter, said swaged segment being sized to receive and engage a ledger head both above and below the respective intermediate rosette at various securing positions around the rosette.

2. A scaffold support post as claimed in claim 1 wherein said inwardly recessed swaged segment of said at least one intermediate rosette is of a wall thickness greater than the wall thickness of said support tube in a region of said first diameter.

3. A scaffold support post as claimed in claim 1 wherein said inwardly recessed swaged segment includes a swaged area above the rosette and a separate swaged area below the rosette.

4. A scaffold support post as claimed in claim 3 wherein said elongate support tube immediately adjacent said at least one intermediate rosette is of said first diameter.

5. A scaffold support post as claimed in claim 4 including at least two intermediate rosettes and each intermediate rosette includes a circular port sized to initially sleeve over said first diameter of said elongate support tube and is welded to said elongate support tube on a portion of said first diameter.

6. A scaffold support post as claimed in claim 4 wherein said at least one intermediate rosette is welded to a narrow band portion of said elongate support tube and said narrow band portion is of said first diameter.

7. A scaffold support post as claimed in claim 4 as part of an integrated scaffold post and scaffold frame system wherein each scaffold frame includes connected upright members and each upright member is a tube member of a diameter corresponding to a diameter of said swaged segment.

8. A scaffold support post as claimed in claim 7 wherein said scaffold frames include rosettes for connecting frames to frames or frames to support posts using the same connecting components and maintaining the same grid spacing whereby a frame can be replaced by two scaffold posts or two appropriately spaced support posts can be replaced with a frame without altering the grid spacing.

9. A scaffold support post as claimed in claim 1 wherein said elongate support tube has a first diameter of approximately 48 mm and a wall thickness of approximately 3 mm.

10. A scaffold support post as claimed in claim 9 wherein said swaged segment is of a reduced diameter of approximately 42 mm.

11. A scaffold support post as claimed in any of claim 10 wherein said elongate tube is an extruded tube of a steel material.

12. A scaffold support post as claimed in claim 11 having at least 2 intermediate rosettes spaced in the length of said elongate support tube.

13. An integrated scaffolding system comprising scaffold support posts, scaffold frames, and connecting ledgers and diagonal braces for securing said scaffold posts and said scaffold frames in predetermined modular spacing that allows scaffold posts to be substituted for scaffold frames while maintaining the same modular spacing; and wherein each scaffold support post comprising an elongate support tube with a series of securing rosettes at spaced positions in a length of said elongate support tube including at least one securing rosette intermediate the length of said elongate support tube; said elongate support tube being of a first diameter and including adjacent each intermediate securing rosette an inwardly recessed swaged segment of reduced diameter having portions generally parallel to and positioned inwardly of said first diameter sized to receive and engage a ledger head both above and below the respective intermediate rosette at various securing positions around the rosette.

14. An integrated scaffolding system as claimed in claim 13 wherein said inwardly recessed swaged segment is of a an outer diameter less than an inner diameter of said elongate tube in a non swaged region.

15. An integrated scaffolding system as claimed in claim 13 wherein said inwardly recessed swaged segment includes an area above the rosette of reduced diameter and a separate area below the rosette of said reduced diameter.

16. An integrated scaffolding system as claimed in claim 15 wherein said elongate support tube immediately adjacent each intermediate rosette is of said first diameter.

17. An integrated scaffolding system as claimed in claim 16 wherein each intermediate rosette includes a circular port sized to initially sleeve over said first diameter of said elongate support tube and is welded to said support tube on a portion of said first diameter.

18. An integrated scaffolding system as claimed in claim 17 wherein each intermediate rosette is welded to a narrow band portion of said elongate support tube and said narrow band portion is of said first diameter.

19. An integrated scaffolding system as claimed in claim 13 wherein said elongate support tube has a first diameter of approximately 48 mm and a wall thickness of approximately 3 mm and said reduced diameter is of an outer diameter of approximately 42 mm and upright support members of said scaffold frames have a diameter of 42 mm.

20. An integrated scaffolding system as claimed in claim 13 wherein said scaffold support posts each have at least 2 intermediate rosettes spaced in the length of said elongate support tube.

* * * * *